US009404283B1

(12) United States Patent
Lo

(10) Patent No.: US 9,404,283 B1
(45) Date of Patent: Aug. 2, 2016

(54) FENCE STRUCTURE

(71) Applicant: Chong-Yi Lo, Sherman Oaks, CA (US)

(72) Inventor: Chong-Yi Lo, Sherman Oaks, CA (US)

( * ) Notice: Subject to any disclaimer, the term of this patent is extended or adjusted under 35 U.S.C. 154(b) by 0 days.

(21) Appl. No.: 14/825,218

(22) Filed: Aug. 13, 2015

(51) Int. Cl.
*E04H 17/00* (2006.01)
*E04H 17/14* (2006.01)
*E04H 17/20* (2006.01)

(52) U.S. Cl.
CPC ..... *E04H 17/1439* (2013.01); *E04H 17/20* (2013.01); *E04H 2017/1478* (2013.01)

(58) Field of Classification Search
None
See application file for complete search history.

(56) References Cited

U.S. PATENT DOCUMENTS 4,821,481 A * 4/1989 Woodman ..... E04C 2/422 411/508
6,375,166 B1 * 4/2002 Schall ..... E04H 17/1439 256/21
7,152,849 B2 * 12/2006 Graber ..... E04H 17/1443 256/22
7,384,025 B2 6/2008 Lo
8,413,332 B2 * 4/2013 Duffy ..... E04H 17/1439 256/65.12
8,413,965 B2 4/2013 Duffy et al.
9,027,909 B1 * 5/2015 Peyton ..... E04H 17/1439 256/67
9,151,075 B2 * 10/2015 Duffy ..... E04H 17/1439
2010/0200827 A1 * 8/2010 Duffy ..... E04H 17/1439 256/67
2011/0042637 A1 * 2/2011 Howard ..... E04H 17/1439 256/22
2011/0233499 A1 * 9/2011 Stinson ..... E04H 17/143 256/65.01
2013/0026433 A1 * 1/2013 Duffy ..... E04H 17/1439 256/67
2013/0032772 A1 * 2/2013 Duffy ..... E04H 17/1439 256/65.01

* cited by examiner

*Primary Examiner* — Victor MacArthur
(74) *Attorney, Agent, or Firm* — Alan D. Kamrath; Kamrath IP Lawfirm, P.A.

(57) ABSTRACT

A fence structure includes a plurality of vertical pickets, at least one connecting strip, a plurality of pivot members, and at least one transverse railing. One end of the pivot member is provided with a stop portion whose outer diameter is larger than the inner diameter of the pivot hole of the vertical picket. The stop portion may limit the pivot member and prevent the pivot member from slipping axially after passing through the connecting strip and the vertical picket. By the aforesaid arrangement, the pivot member not only allows the angle of the transverse railing and the connecting strip to be adjustable according to needs, but also prevents the connecting strip and the vertical pickets from slipping or disconnecting resulting when being exerted by a pulling or pushing force.

6 Claims, 10 Drawing Sheets

FENCE STRUCTURE

BACKGROUND OF THE INVENTION

1. Field of the Invention

The present invention relates to a fence structure that may reinforce the combination strength of the fence assemblies to keep steady even under being exerted a pulling or pushing force, and allows the angle of the transverse railing and the vertical picket to be adjustable.

2. Description of the Prior Art

As disclosed in U.S. Pat. No. 7,384,025, the prior art fence assembly provides a screw hiding device for combining lateral tubes with upright tubes. The screw hiding device includes a position strip arranged inside the lateral tube. By such an arrangement, the screws and the position strips are allowed to be hidden to beautify the appearance of the fence structure.

An alternative prior art fence assembly disclosed in U.S. Pat. No. 8,413,965 comprises a plurality of vertical pickets which have at least one pivot hole formed therein, a plurality of rails which extend transversely to the vertical pickets and whose top wall provides a plurality of picket openings corresponding to the plurality of vertical pickets to receive the plurality of vertical pickets, and one or more boss strips which are arranged transversely to the side of the vertical picket providing the pivot hole. The boss strip includes a protruding structure corresponding to the pivot hole, and the protruding structure is received inside the pivot hole to allow the boss strip and the vertical picket to rotate pivotally according to needs. The boss strip is arranged between the rail and the vertical picket to hold the rail to avoid sliding down, as shown in FIG. 4 of U.S. Pat. No. 8,413,965. The outer wall of the protruding structure of the boss strip disclosed in U.S. Pat. No. 8,413,965 is a conical surface, such that the rail and the boss strip can only rotate pivotally when the protruding structure is inserted inside the pivot hole. However, the boss strip can not prevent axially-slipping. Hence, the protruding structure whose outer wall is a conical surface will slip easily out of the pivot hole to cause the transverse rail to displace or unfasten when the fence rail or the vertical picket is pushed or pulled by exterior forces. Therefore, the aforesaid structure needs to be improved.

SUMMARY OF THE INVENTION

It is against the background and the drawbacks associated therewith that the present invention has been developed.

A primary object objective of the present invention is to provide a fence structure that may reinforce the combination strength of the fence assemblies to keep steady even when being exerted by a pulling or pushing force, and allows the angle of the transverse railing and the vertical picket to be adjustable.

In order to achieve the aforesaid objective, the fence structure disclosed in the present invention comprises a plurality of vertical pickets, at least one connecting strip, a plurality of pivot members, and at least one transverse railing. One end of the pivot member is provided with a stop portion whose outer diameter is larger than the inner diameter of the pivot hole of the vertical picket. The stop portion may limit the pivot member and prevent the pivot member from slipping axially after passing through the connecting strip and the vertical picket. By the aforesaid arrangement, the pivot member not only allows the angle of the transverse railing and the connecting strip to be adjustable according to needs, but also prevents the connecting strip and the vertical pickets from slipping or disconnecting resulting when being exerted by a pulling or pushing force.

BRIEF DESCRIPTION OF THE DRAWINGS

In order that the present invention may be more fully understood, preferred embodiments thereof will now be described with reference to the accompanying drawings, in which.

DESCRIPTION OF THE PREFERRED EMBODIMENTS

Figure 1:
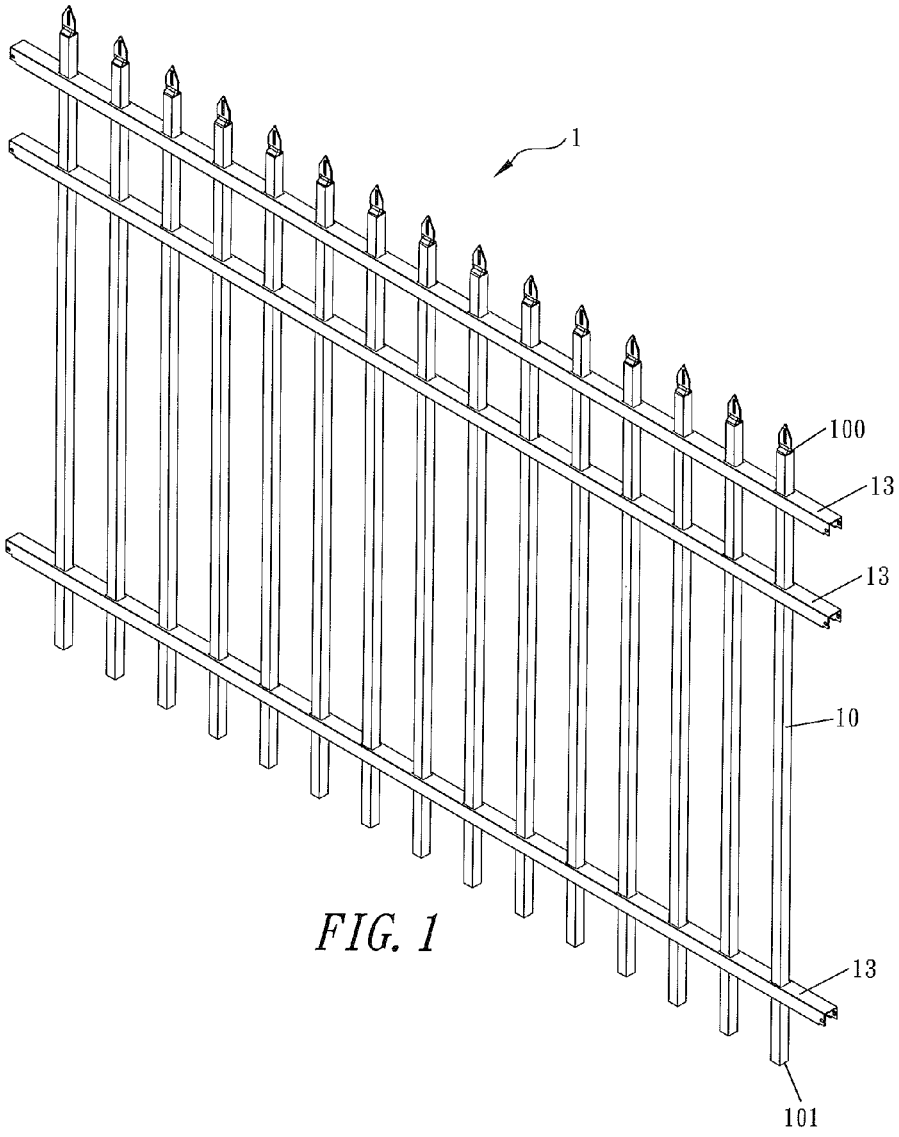
FIG. 1 is a stereogram showing the combination of a first embodiment of the present invention.

The means for achieving the aforesaid objective and the functions of the present invention will become apparent from the following description, taken in connection with the accompanying drawings, wherein preferred embodiments of the present invention are disclosed.

Referring to FIG. 1 to FIG. 5, there is shown a fence structure 1 in accordance with a first embodiment of the present invention. The fence structure 1 includes a plurality of vertical pickets 10 having an upper end 100 and a bottom end 101. A sidewall of the vertical picket between the upper end 100 and the bottom end 101 is provided with at least one pivot hole 102.

Figure 2:
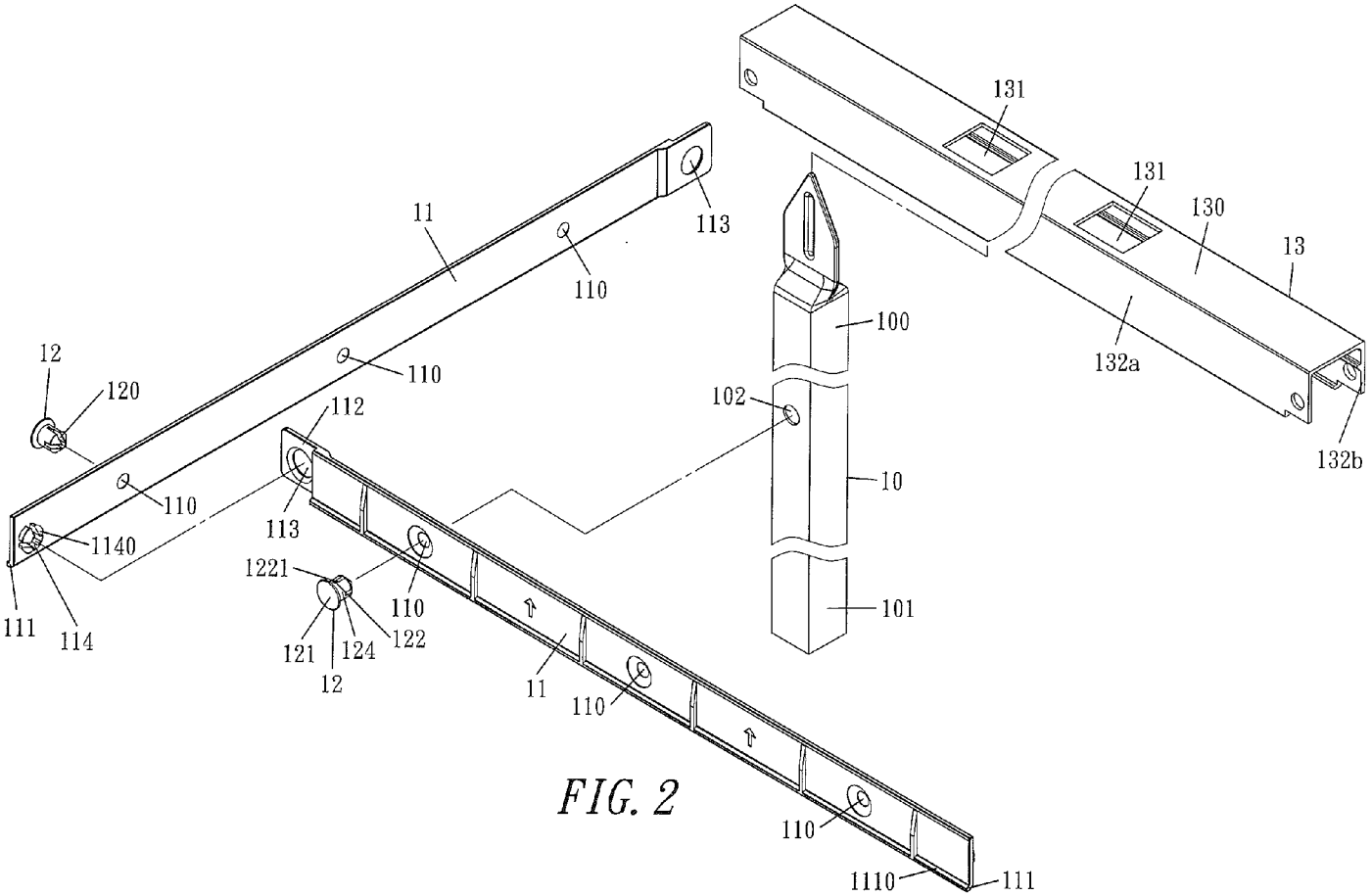
FIG. 2 is a breakdown stereogram of the first embodiment of the present invention.
Figure 4:
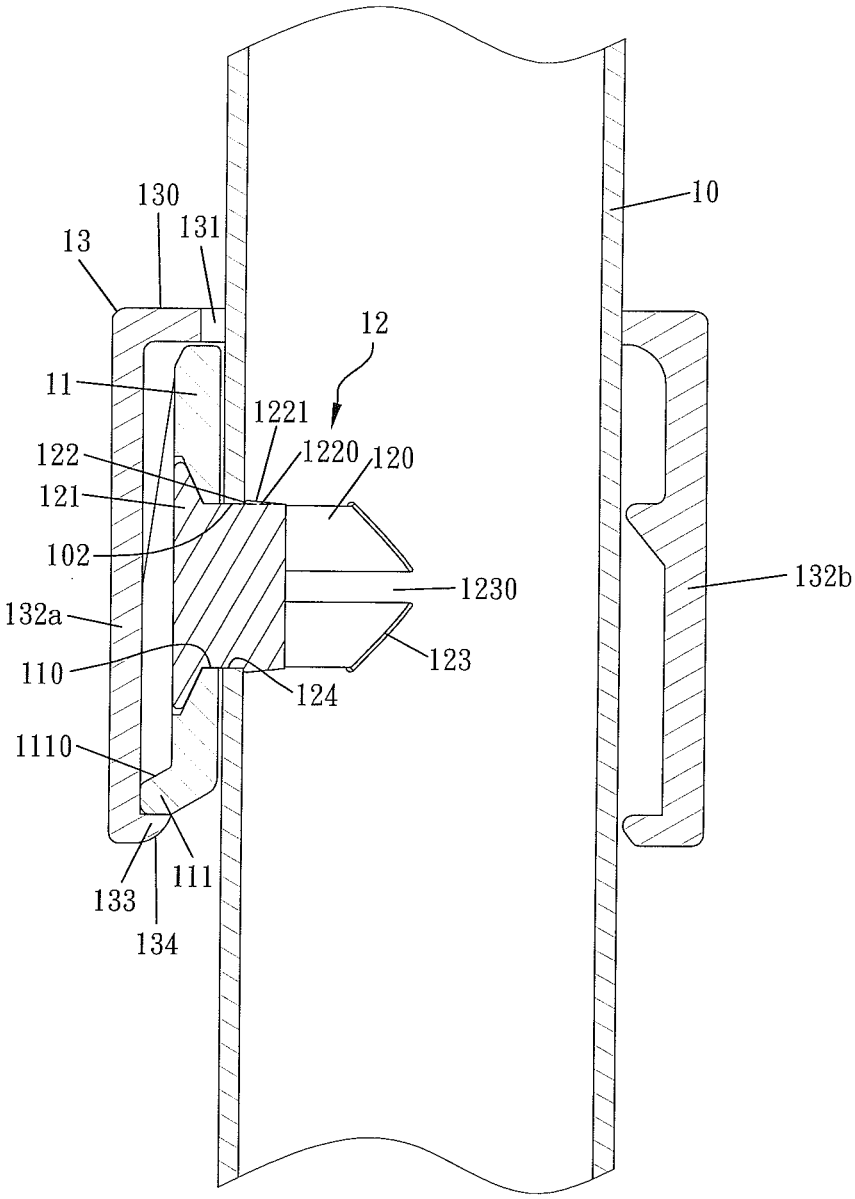
FIG. 4 is a longitudinal sectional view of the first embodiment of the present invention.

Referring to FIG. 2, at least one connecting strip 11 is arranged transversely to sidewalls of the plurality of vertical pickets 10 provided with the pivot holes 102. The connecting strip 11 provides a through-hole 110 at the position corresponding to each pivot hole 102 of each single vertical picket 10. One side of the connecting strip 11 leans tightly against the plurality of vertical pickets 10. As shown in FIG. 4, the bottom end of the connecting strip 11 provides a fastening surface 111 extending outward in a direction away from the vertical picket 10, and the top surface of the fastening surface 111 is provided with a first oblique sliding surface 1110. In order to enable one connecting strip 11 to connect with another connecting strip 11, either a left or right end of the connecting strip 11 is arranged with a bent strip-coupling element 112 whose center provides a perforation hole 113, and the other end of the connecting strip 11 (opposite to the strip-coupling element 112), at the position corresponding to the perforation hole 113, is disposed with a protruding clasping element 114 whose end side provides outward hooks 1140. The perforation hole 113 is used for receiving the clasping element 114. After the clasping element 114 of one connecting strip 11 inserts into the perforation hole 113 of another connecting strip 11, the hooks 1140 clasp the edge of the perforation hole 113 to allow those connecting strips 11 to be combined together, as shown in FIG. 5.

Figure 3:
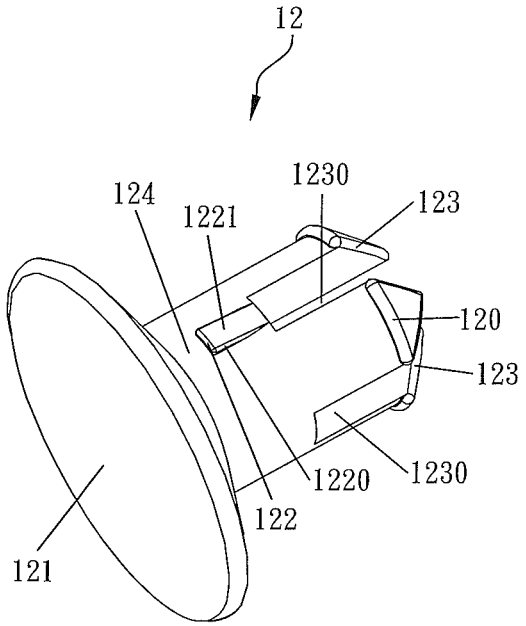
FIG. 3 is a stereogram showing the pivot member of the first embodiment of the present invention.

A plurality of pivot members 12, as shown in FIG. 3, allows the connecting strip 11 to be pivotally connected with the vertical picket 10, as shown in FIG. 4. One end of the pivot member 12 provides an inserting end 120, which is allowed to insert through the through-hole 110 and the pivot hole 102, as shown in FIG. 4. The other end of the pivot member 12 (opposite to the end of the inserting end 120) provides a limiting end 121 whose diameter is larger than the diameter of the through-hole 110. The middle portion of the pivot member 12 provides a middle section 124 which is between the inserting end 120 and the limiting end 121 and whose outer diameter is smaller than the inner diameter of the through-hole 110 and the pivot hole 102. The outer wall of the inserting end 120 adjacent to the middle section 124 is provided with a plurality of outwards-protruding stop elements 1220 arranged annularly to form a stop portion 122. The outer diameter of the stop portion 122 is larger than the inner diameter of the pivot hole 102. The outer wall of the stop portion 122 provides a slanting guiding surface 1221. The slanting guiding surface 1221 has one end wider in diameter than the other end, and the wider end in diameter is near the middle section 124. The inserting end 120 provides an inclined surface 123 which is away from the middle section 124. The outer diameter of the inclined surface 123 gradually increases from the inserting end 120 towards the middle section 124, as shown in FIG. 3. The middle of the inclined surface 123 is arranged with at least one axially-cut opening 1230 to enable the inserting end 120 to pass through the through-hole 110 and the pivot hole 102 easily.

At least one transverse railing 13, as shown in FIG. 2, is provided with a top wall 130. The top wall 130 is arranged with a plurality of spaced picket-holes 131 for receiving the plurality of vertical pickets 10 respectively. The diameter of the picket-hole 131 is larger than the diameter of the vertical picket 10. The front and rear ends of the top wall 130 respectively extend downwards to form a front connecting surface 132*a* and a rear connecting surface 132*b*. The bottom end of the front connecting surface 132*a* extends towards the fastening surface 111 of the connecting strip 11 to form a locking lip 133, whose bottom wall provides a second oblique sliding surface 134, as shown in FIG. 4.

Figure 5:
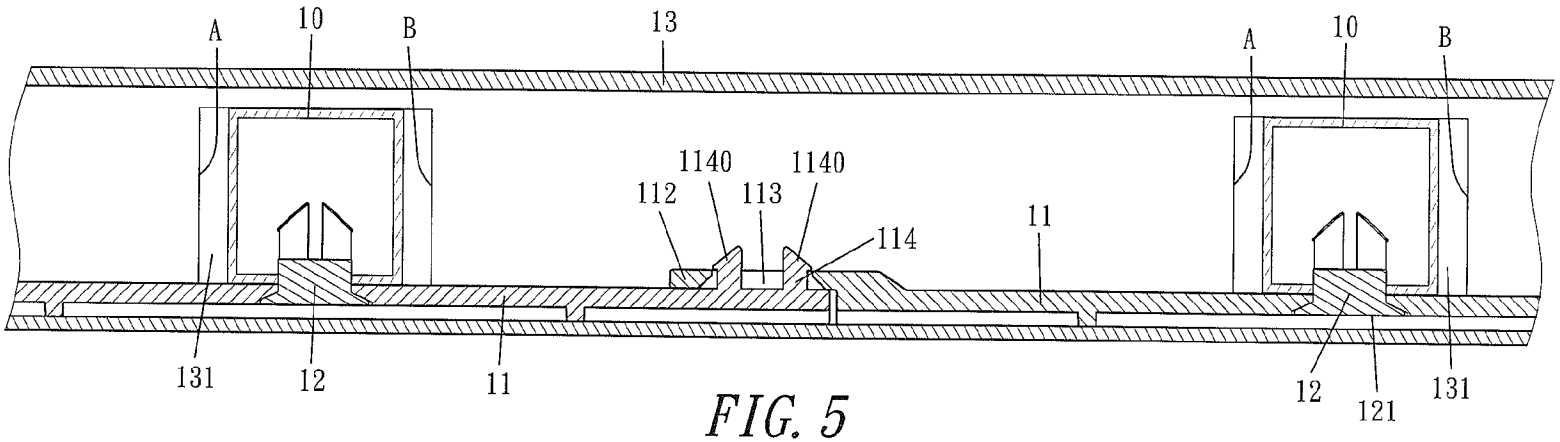
FIG. 5 is a transverse sectional view of the first embodiment of the present invention.
Figure 8:
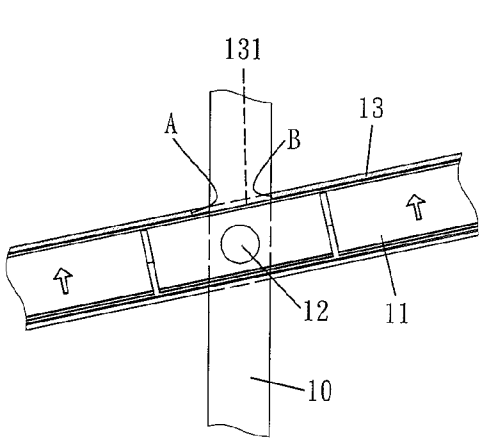

Referring to FIG. 2, FIG. 4 and FIG. 5, when assembling, each through-hole 110 of the connecting strip 11 is aligned respectively with its relative pivot hole 102 of the vertical picket 10, and the inserting end 120 of the pivot member 12 is inserted in the through-hole 110 and the pivot hole 102 to the bottom. The slanting guiding surface 1221 on the outer wall of the stop portion 122 of the pivot member 12 slides through the edge of the pivot hole 102 to be against the outer wall of the pivot hole 102 in the vertical picket 10, as shown in FIG. 4. The limiting end 121 at one end of the pivot member 12 is stopped by the connecting strip 11, and the stop portion 122 of the inserting end 120 at the other end is limited by the vertical picket 10, so that the pivot member 12 will not slip away from the through-hole 110 and the pivot hole 102. By the aforesaid arrangement, the connecting strip 11 is allowed to be transversely attached to one side of the plurality of vertical pickets 10, and the connecting strip 11 may also rotate pivotally on the vertical picket 10 via the pivot member 12. Next, the plurality of spaced picket-holes 131 of the transverse railing 13 is aligned with the plurality of vertical pickets 10 respectively. The vertical pickets 10 are combined with the transverse railing 13 in a top-down manner. The locking lip 133 of the bottom end of the front connecting surface 132*a* of the transverse railing 13 is allowed to pass through the surface of the first oblique sliding surface 1110 of the fastening surface 111 of the connecting strip 11 by the second oblique sliding surface 134 to slide to the bottom of the fastening surface 111 of the connecting strip 11 to enable the bottom wall of the top wall 130 of the transverse railing 13 to tightly touch the top end of the connecting strip 11, and the bottom end of the transverse railing 13 is allowed to clasp the bottom of the fastening surface 111 of the connecting strip 11. The transverse railing 13 and the vertical pickets 10 are secured and combined together by the connecting strip 11. Moreover, the connecting strip 11 and the pivot member 12 are concealed within the transverse railing 13. The transverse railing 13 and the connecting strip 11 may simultaneously rotate pivotally within a limited angle.

Figure 7:
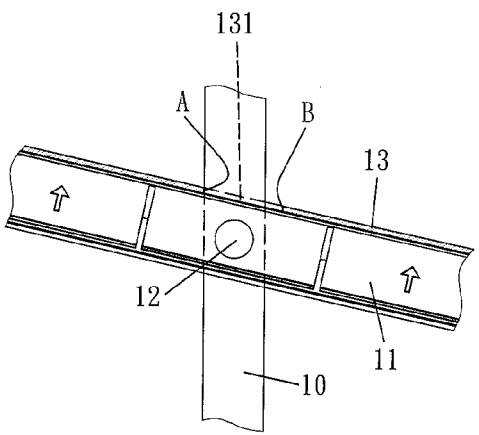
Figure 6:
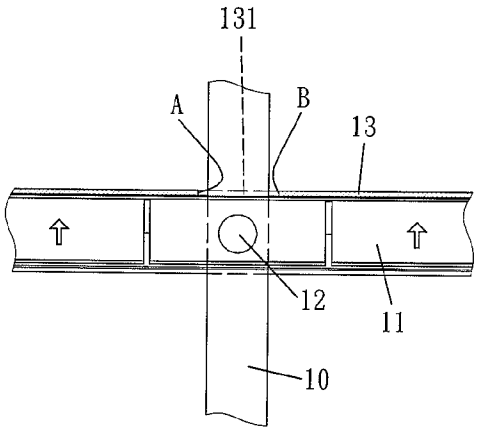
FIG. 6, 7, 8 are schematic diagrams showing rotation angles of the transverse railing according to the first embodiment of the present invention.

Referring to FIG. 5 to FIG. 7, the angle of both the transverse railing 13 and the connecting strip 11 of the fence structure 1 is adjustable according to a certain landform. The pivot member 12 is the pivot point for the angle adjustment of the transverse railing 13 and the connecting strip 11. The inner walls A and B of the picket-hole 131 of the transverse railing 13 are the largest range/angle that the transverse railing 13 and the connecting strip 11 may pivotally rotate to, as shown in FIG. 5 to FIG. 8.

Figure 9:
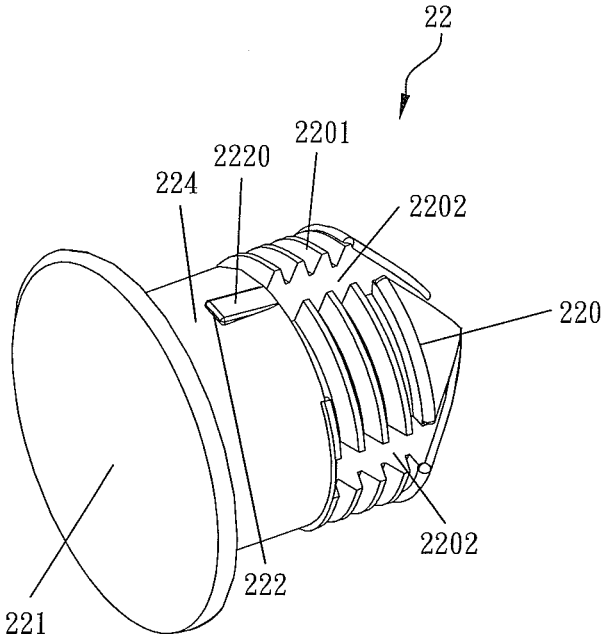
FIG. 9 is a stereogram showing the pivot member of a second embodiment of the present invention.
Figure 10A:
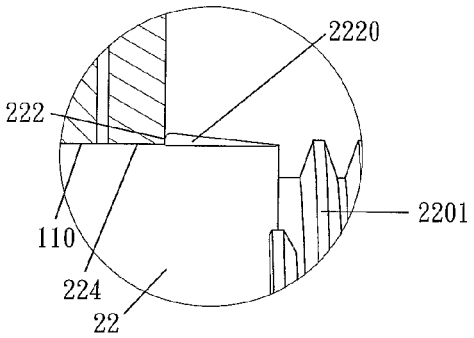
FIG. 10*a* is a partially enlarged view of FIG. 10.
Figure 10:
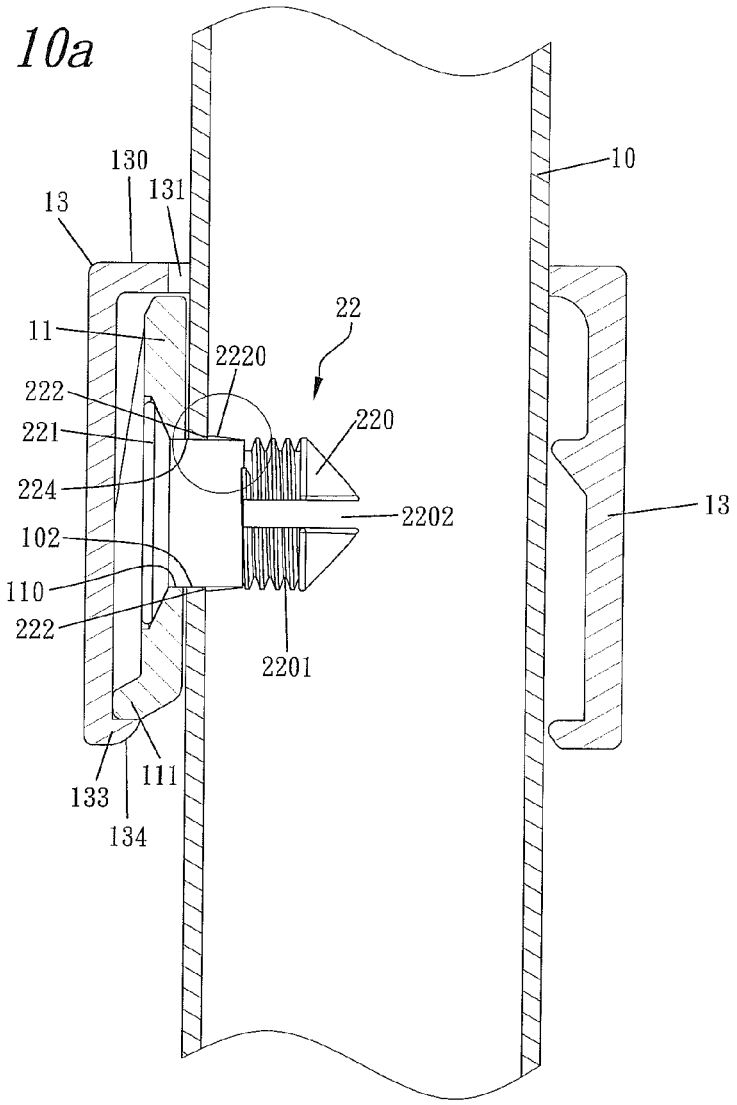
FIG. 10 is a sectional view showing the combination of the second embodiment of the present invention.

Referring to FIG. 9 and FIG. 10, there is shown a pivot member 22 in accordance with a second embodiment of the present invention. The pivot member 22 includes a limiting end 221 at one end, an inserting end 220 at the opposite end, and a middle section 224 between the inserting end 220 and the limiting end 221. The outer wall of the inserting end 220 adjacent to the middle section 224 is provided with a stop portion 222 including a plurality of outwards-protruding stop elements 2220 arranged annularly. The outer diameter of the stop portion 222 is larger than the inner diameter of the pivot hole 102. The outer wall of the inserting end 220 provides an outer threaded section 2201, arranged adjacent to the plurality of outwards-protruding stop elements 2220. Moreover, the inserting end 220 is also arranged with at least one axially-cut opening 2202. When the inserting end 220 of the pivot member 22 inserts into the through-hole 110 and the pivot hole 102, the at least one axially-cut opening 2202 is in a state of being squeezed, and after the inserting end 220 of the pivot member 22 passes through the through-hole 110 and the pivot hole 102, the at least one axially-cut opening 2202 returns to its original state. The stop portion 222 can prevent the pivot member 22 from sliding out of the pivot hole 102.

Figure 11:
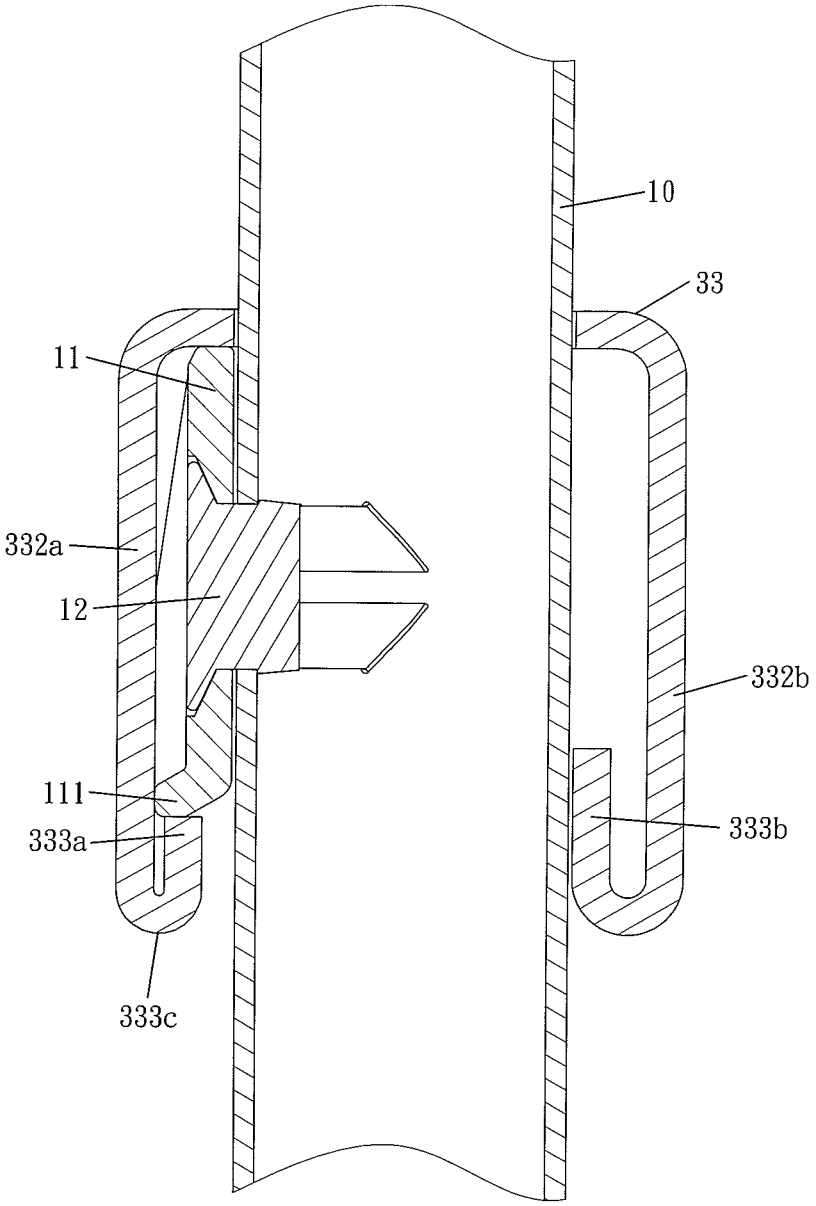
FIG. 11 is a sectional view showing the combination of a third embodiment of the present invention.
Figure 12:
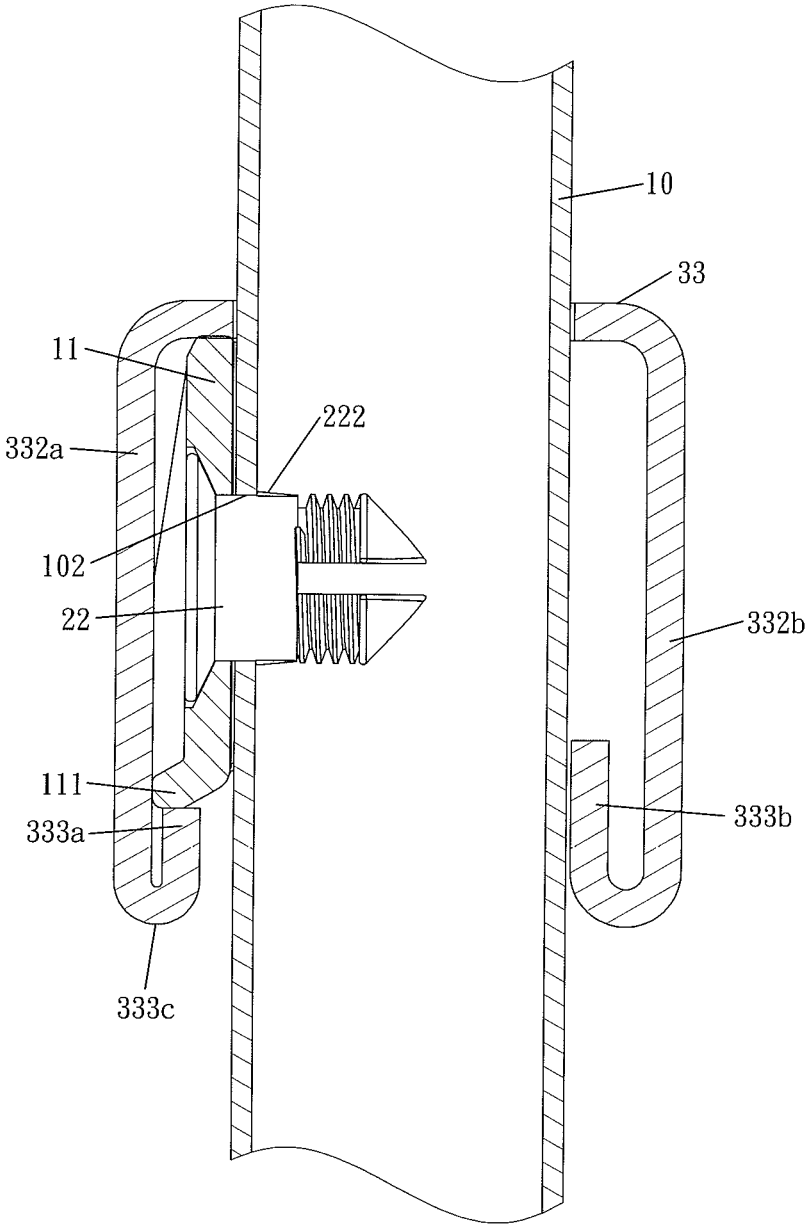
FIG. 12 is a sectional view showing the combination of a fourth embodiment of the present invention.

Referring to FIG. 11, the difference between a first embodiment and a third embodiment of the present invention is described as follows: the transverse railing 33 disclosed in the third embodiment includes a front connecting surface 332*a* and a rear connecting surface 332*b*. The bottom ends of the front connecting surface 332*a* and the rear connecting surface 332*b* are respectively bent towards the inner side of the transverse railing 33 and extend upwards to form a front locking lip 333*a* and a rear locking lip 333*b*. The bottom end of the front locking lip 333*a* has an arc surface 333*c*, which may facilitate downward-sliding through the fastening surface 111 to allow the top end of the front locking lip 333*a* to support the fastening surface 111 of the connecting strip 11 when being located and secured. Referring to FIG. 12, there is shown a combination of the transverse railing 33 of the third embodiment and the pivot member 22 of a second embodiment shown in FIG. 9 and FIG. 10. The stop portion 222 of the pivot member 22 is allowed to be against the edge of the pivot hole 102 of the inner side end of the vertical picket 10 to prevent the pivot member 22 from sliding out of the pivot hole 102, as shown in FIG. 12.

According to the aforesaid, the connecting strip and the vertical picket are connected pivotally by the pivot member. Due to the arrangement of the stop portion, the pivot member also provides functions of fixing and slip-preventing. That is, even when an external force of pulling or pushing is exerted on the picket or railing, the pivot member will not slip away, to enable the connecting strip, the transverse railing and the vertical pickets to stay in place. Thus, the deficiency occurring in the prior art that the connecting strip, the transverse railing and the vertical pickets may displace or unfasten resulting when being exerted a pulling or pushing force is allowed to be ameliorated.

It will be appreciated by those skilled in the art that variations and modifications to the invention described herein will be apparent without departing from the spirit and scope thereof. The variations and modifications as would be apparent to persons skilled in the art are deemed to fall within the broad scope and ambit of the invention as herein set forth.

What is claimed is:

1. A fence structure comprising:

a vertical picket having an upper end and a bottom end, wherein a sidewall of the vertical picket between the upper end and the bottom end is provided with a pivot hole;

a connecting strip provided with a through-hole corresponding to the pivot hole and is arranged transversely to the sidewall of the vertical picket disposed with the pivot hole, wherein one end of the connecting strip is arranged with a bent strip-coupling element whose center provides a perforation hole, and another end of the connecting strip is disposed with a protruding clasping element which corresponds to the perforation hole and whose side provides outward hooks;

a pivot member inserted in the through-hole and the pivot hole to pivotally connect the connecting strip with the vertical picket, wherein the pivot member provides an inserting end at one end, a limiting end at the opposite end, and a middle section between the inserting end and the limiting end, wherein the limiting end is larger than the through-hole in diameter, the middle section in a state of being inserted within the through-hole and the pivot hole has a smaller diameter than the through-hole and the pivot hole, and the inserting end is inside the vertical picket after passing through the pivot hole; wherein an outer wall of the inserting end is provided with an outward-protruding stop portion whose outer diameter is larger than the inner diameter of the pivot hole, and the outer wall provides a slanting guiding surface having one end with a wider diameter than an opposite end, wherein the one end of the slanting guiding surface is near the middle section; and a transverse railing arranged transversely on the vertical picket to allow the connecting strip to be hid inside and is provided with a top wall having a picket-hole receiving the vertical picket, wherein the top wall provides a front end and a rear end respectively extending downwards to form a front connecting surface and a rear connecting surface, and wherein a bottom end of the front connecting surface tightly touches a bottom end of the connecting strip and a bottom wall of the top wall tightly touches a top end of the connecting strip.

2. The fence structure as claimed in claim 1, wherein the bottom end of the connecting strip extends outward in a direction away from the vertical picket to form a fastening surface whose top surface is provided with a first oblique sliding surface, and wherein the bottom end of the front connecting surface extends towards the fastening surface to form a locking lip whose bottom wall provides a second oblique sliding surface.

3. The fence structure as claimed in claim 1, wherein the bottom end of the connecting strip extends outward in a direction away from the vertical picket to form a fastening surface whose top surface is provided with a first oblique sliding surface, and wherein the bottom end of the front connecting surface of the transverse railing is bent towards an inner side of the transverse railing and extend upwards to form a front locking lip whose bottom end provides an arc surface which allows the transverse railing to downwards slide through the fastening surface to be combined with the connecting strip.

4. The fence structure as claimed in claim 1, wherein the outwardly protruding stop portion of the pivot member includes a plurality of stop elements arranged annularly.

5. The fence structure as claimed in claim 4, wherein the inserting end of the pivot member provides an inclined surface away from the middle section, wherein the inclined surface has an outer diameter that gradually increases from the inserting end towards the middle section, and the middle of the inclined surface is arranged with at least one axially-cut opening to enable the inserting end to pass through the through-hole and the pivot hole easily.

6. The fence structure as claimed in claim 5, wherein the outer wall of the inserting end of the pivot member provides an outer threaded section arranged adjacent to the plurality of stop elements.

* * * * *